US006806646B2

(12) United States Patent
Lapatovich et al.

(10) Patent No.: US 6,806,646 B2
(45) Date of Patent: Oct. 19, 2004

(54) UV ENHANCER FOR A METAL HALIDE LAMP

(75) Inventors: Walter P. Lapatovich, Boxford, MA (US); A. Bowman Budinger, Westford, MA (US)

(73) Assignee: Osram Sylvania Inc., Danvers, MA (US)

( * ) Notice: Subject to any disclaimer, the term of this patent is extended or adjusted under 35 U.S.C. 154(b) by 59 days.

(21) Appl. No.: 09/961,577

(22) Filed: Sep. 24, 2001

(65) Prior Publication Data

US 2003/0057833 A1 Mar. 27, 2003

(51) Int. Cl.[7] ..... H01J 61/34
(52) U.S. Cl. ..... 313/595; 313/25
(58) Field of Search ..... 313/595, 570, 313/637, 639, 25, 643, 567, 546

(56) References Cited

U.S. PATENT DOCUMENTS

| | | | | | |
|---|---|---|---|---|---|
| 4,247,800 | A | | 1/1981 | Proud et al. | 315/39 |
| 4,427,923 | A | * | 1/1984 | Proud et al. | 315/248 |
| 4,818,915 | A | * | 4/1989 | Zaslavsky et al. | 315/60 |
| 4,874,984 | A | * | 10/1989 | Sigai et al. | 313/486 |
| 5,070,277 | A | | 12/1991 | Lapatovich | 315/248 |
| 5,151,633 | A | | 9/1992 | Farrall et al. | 315/248 |
| 5,323,091 | A | * | 6/1994 | Morris | 315/344 |
| 5,397,259 | A | * | 3/1995 | Zaslavsky et al. | 445/29 |
| 5,811,933 | A | * | 9/1998 | Van Den Nieuwenhuizen et al. | 313/570 |
| 5,942,840 | A | * | 8/1999 | Steere et al. | 313/25 |
| 5,990,599 | A | * | 11/1999 | Jackson et al. | 313/25 |
| 6,392,343 | B1 | * | 5/2002 | Luijks et al. | 313/570 |

OTHER PUBLICATIONS

Vos et al., *Ultraviolet Enhancers Made From Polycrystalline Alumina to Eliminate Ignition Delay*, International Symposium for the Science & Technology of Light Sources, LS:9, (Aug. 2001).

* cited by examiner

*Primary Examiner*—Joseph Williams
*Assistant Examiner*—Dalei Dong
(74) *Attorney, Agent, or Firm*—Robert F. Clark

(57) ABSTRACT

A starting aid for a metal halide lamp uses iodine and an inert gas instead of mercury so that the entire metal halide lamp may be mercury-free. The starting aid is a UV enhancer that includes a UV-transmissive capsule with a cavity in which iodine and an inert gas are sealed, wherein the iodine emits UV radiation when excited to reduce a starting voltage of the lamp.

21 Claims, 3 Drawing Sheets

UV ENHANCER FOR A METAL HALIDE LAMP

BACKGROUND OF THE INVENTION

The present invention generally relates to metal halide lamps, and more specifically relates to a metal halide lamp that relies on the application of a high voltage to start the lamp and that uses a starting aid to reduce the starting voltage of the lamp.

Metal halide lamps start upon application of a high voltage between two main electrodes or to an inductive start system. Metal halide lamps which do not contain UV enhancers require higher voltage pulses to release avalanche initiating electrons. Initiating electrons, in this manner, are believed to be released from the electrode by field emission or by field extraction from charges in shallow traps on the wall of the arc tube. However, not all sockets into which such lamps are inserted have the capacity to carry the high voltage needed to start the lamps. Accordingly, a starting aid, also known as an ultraviolet (UV) enhancer, is provided in such lamps. The UV enhancer emits UV radiation that causes the release of photoelectrons into the main body of the lamp. The photoelectrons reduce the voltage needed to start the lamp. Rapid starting eliminates the sockets from being stressed by long-term exposure to the high starting voltages. This reduces the probability of socket failure.

The UV enhancer also reduces the statistical lag time between the time of application of the high voltage and the lamp breakdown (ignition) as defined by the drawing current. This is important in mercury-free lamps because such lamps typically have a ballast with a time-out feature. The ballast attempts to start the lamp for a predetermined period of time and then shuts off. If the statistical time lag is too long, the ballast interprets the delay as an inoperative lamp and shuts off too soon.

A typical metal halide lamp includes a discharge vessel in an outer bulb. The discharge vessel has two electrodes that receive the voltage for starting the lamp. The UV enhancer is located within the outer bulb and connected to one of the electrodes. The UV enhancer is positioned close to the other electrode to allow capacitive coupling. A gas inside the UV enhancer is partially ionized by the capacitive coupling and emits UV light that aids in starting the lamp. Construction and operation of such lamps is well known and described, for example, in U.S. Pat. No. 5,942,840 that is incorporated by reference. The lamp may also be electrodeless, such as described in U.S. Pat. No. 5,070,277 that is also incorporated by reference.

The conventional UV enhancer is a capsule with a sealed cavity that contains a gas or a mixture of gases, such as mercury vapor and an inert gas (argon, helium, krypton, neon, or xenon). An electrode extends into the cavity and provides a voltage from one of the discharge vessel electrodes. Upon application of the starting voltage, a capacitive discharge starts in the capsule causing the capsule to emit UV radiation, which in turn causes the release of photoelectrons in the lamp, which in turn lowers the voltage needed to start the lamp.

The practical and legal reasons for avoiding the use of mercury in lamps are well known. While much attention has been directed to removing mercury from the main lamp (e.g., the discharge vessel), the starting aid still may contain mercury. The effort to remove mercury entirely from lamps has included removing the mercury vapor from the UV enhancer so that the sealed cavity includes only an inert gas, typically argon. However, insufficient UV radiation escapes the capsule when argon is used and this solution is not satisfactory for most lamps.

SUMMARY OF THE INVENTION

The invention is an improvement in which the starting aid does not include mercury, thereby allowing the metal halide lamp to be entirely mercury-free. The starting aid of the present invention uses iodine and an inert gas instead of mercury.

An object of the present invention is to provide a novel UV enhancer that avoids the problems of the prior art and provides sufficient UV radiation by employing iodine and an inert gas instead of mercury.

A further object of the present invention is to provide a novel UV enhancer for a metal halide lamp that includes a UV-transmissive capsule with a cavity in which iodine and an inert gas are sealed, wherein the iodine emits UV radiation when excited to reduce a starting voltage of the lamp.

Another object of the present invention is to provide a novel metal halide lamp that includes a discharge vessel inside an outer tube, and a UV transmitting starting aid in the outer tube that includes a capsule with a cavity that has iodine and an inert gas sealed therein.

Yet another object of the present invention is to provide a novel method of starting a metal halide lamp in which a starting voltage of the lamp is lowered by exciting iodine sealed with an inert gas in a UV enhancer to cause emission of UV radiation that lowers the starting voltage of the lamp.

DESCRIPTION OF PREFERRED EMBODIMENTS

In a preferred embodiment, the UV enhancer of the present invention finds application in a metal halide lamp. The UV enhancer includes a UV-transmissive capsule with a cavity in which iodine and an inert gas are sealed and that emits UV radiation when the iodine is excited to reduce a starting voltage of the metal halide lamp.

Figure 1:
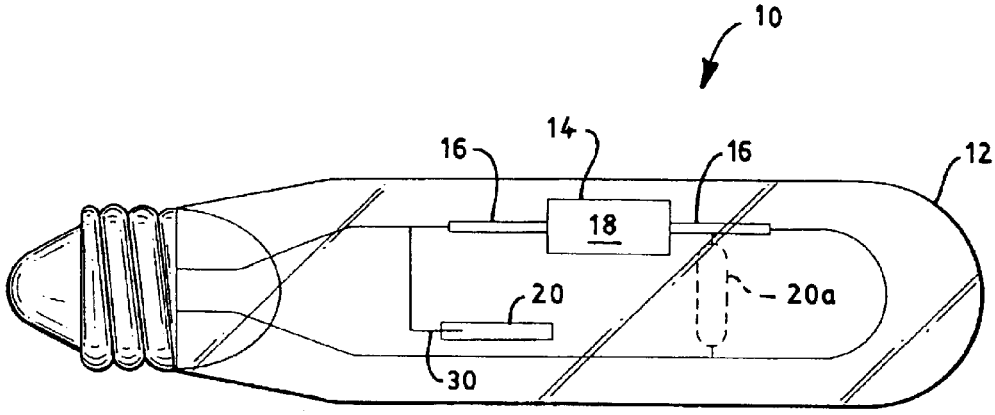
FIG. 1 is a pictorial representation of a metal halide lamp of the present invention.

With reference to FIG. 1, the metal halide lamp 10 includes an outer tube 12, a discharge vessel 14 inside outer tube 12, two discharge electrodes 16 that extend from outside vessel 14 to a discharge space 18 inside vessel 14, and the UV enhancer 20 described above. UV enhancer 20 is near discharge vessel 14, typically at a distance of 1–3 cm, and is next to one of the two discharge electrodes 16, usually the return electrode. This provides a capacitive coupling during application of the starting voltage that causes a transient discharge in UV enhancer 20. This transient discharge produces the UV radiation that reduces the starting voltage for the lamp. Iodine will condense on the metallic electrode structures in UV enhancer 20 and will ablate during the transient discharge. This ensures that the UV enhancer will operate in cold temperatures.

Figure 2:
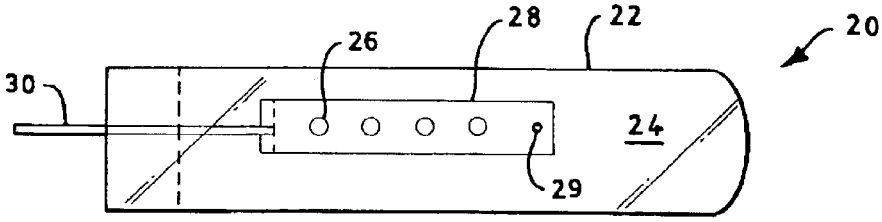
FIG. 2 is a pictorial representation of an embodiment of a UV enhancer of the present invention.
Figure 3:
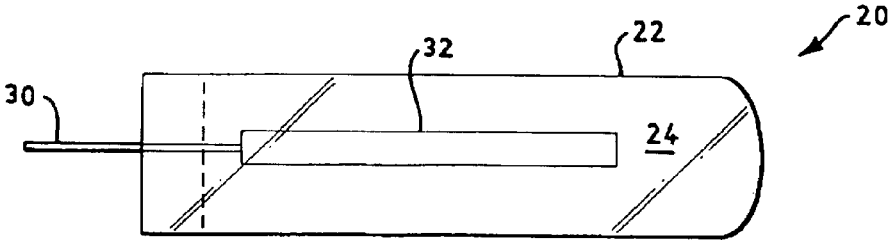
FIG. 3 is a pictorial representation of a further embodiment of a UV enhancer of the present invention.

With reference to FIGS. 2–3, the UV enhancer of the present invention includes a capsule 22 with a cavity 24 therein. Capsule 22 may be made of UV-transmissive material, such as vitreous silica (quartz), Suprasil™, ceramic, or hard glass. Corning™ glass types 9701 and 9741 are examples of available UV-transmissive materials. Capsule 22 may be sealed by crimping (as indicated by the dashed lines at one end of the capsule), frit sealing, or closed in another conventional manner.

Iodine and an inert gas are sealed in cavity 24. As shown in FIG. 2, the iodine may be in solid form 26, such as iodine crystals, and in an inner tube 28 that is convenient for dosing the iodine. The inert gas may be in cavity 24 and outside inner tube 28, so that the iodine crystals and the inert gas are initially separated. Inner tube 28 may include one or more small holes 29 to permit $I_2$ vapor to commingle with the inert gas from cavity 24.

Alternatively, as shown in FIG. 3, the iodine may be in the form of iodine vapor and mixed with the inert gas in cavity 24.

The inert gas may be any inert gas and is preferably argon, xenon, or krypton.

A highly volatile mercury-free compound, such as $CH_3I$, HI, $SiI_4$, and the like, may be used to introduce the iodine into cavity 24. While $HgI_2$ could also be used to introduce the iodine, this compound contains mercury and its use would be contrary to one of the objects of the present invention.

An electrical inlead 30 extends through an end of capsule 22 into cavity 24. Inlead 30 may support inner tube 28 (FIG. 2) or an electrode 32 (FIG. 3). Inlead 30 may be KOVAR™, tungsten, FERNICO™, niobium, or other conventional material. Electrode 32 may be the same material as inlead 30 or molybdenum or other refractory metal. As shown in FIG. 1, inlead 30 is connected to one of the two discharge electrodes 16 for the metal halide lamp.

As noted above, the starting voltage for the metal halide lamp is reduced by emission of UV radiation from the UV enhancer. The UV wavelength range of interest is below 300 nm and preferably below about 250 nm where photons have sufficient energy to create and eject photoelectrons from metallic surfaces in the main lamp. Since these photons also must be able to penetrate the discharge vessel envelope, the shortest useful wavelength is about 180 nm. Spectral emission in this range is achieved by iodine and an inert gas. Iodine vapor disassociates during the starting discharge and produces radiation from atomic iodine with wavelengths of 178.3 and 206.2 nm. These wavelengths contribute to the release of photoelectrons within the main lamp.

Xenon gas generates additional UV radiation in the desired wavelength range when used as the inert gas. At pressures of 0.5 to 300 torr, the xenon interacts with the residual iodine vapor pressure present at room temperature to form short-lived excimer molecules (XeI) during starting discharge. These excimer molecules have a strong transition band at 253 nm (B→X) with a tail to shorter wavelengths. This emission alone is sufficient to produce photoelectrons since the wavelength is almost identical to the 253.7 nm emissions from mercury-filled UV enhancers.

By way of example, when crystalline iodine and xenon are used in an embodiment of the present invention, the xenon pressure may be 0.01 torr to 1 atmosphere, preferably about 50 torr, and the iodine may have a mass of 0.005 to 1 mg, preferably about 0.1 mg. When iodine vapor and xenon are used, the pressure in the UV enhancer may be about 1–10 torr, preferably 3–5 torr. Corresponding amounts may be used for the other inert gases.

In a further embodiment, inlead 30 may be omitted so that the UV enhancer is electrodeless. Capsule 22 would contain only the iodine and the inert gas. This configuration is shown in phantom lines in FIG. 1 and discussed further below in relation to FIG. 4. Electrodeless UV enhancer 20*a* has one end near one discharge electrode 16 and the other end near the other discharge electrode 16. Excitation of the iodine is provided by the starter pulses that capacitively couple to UV enhancer 20*a*.

Figure 4:
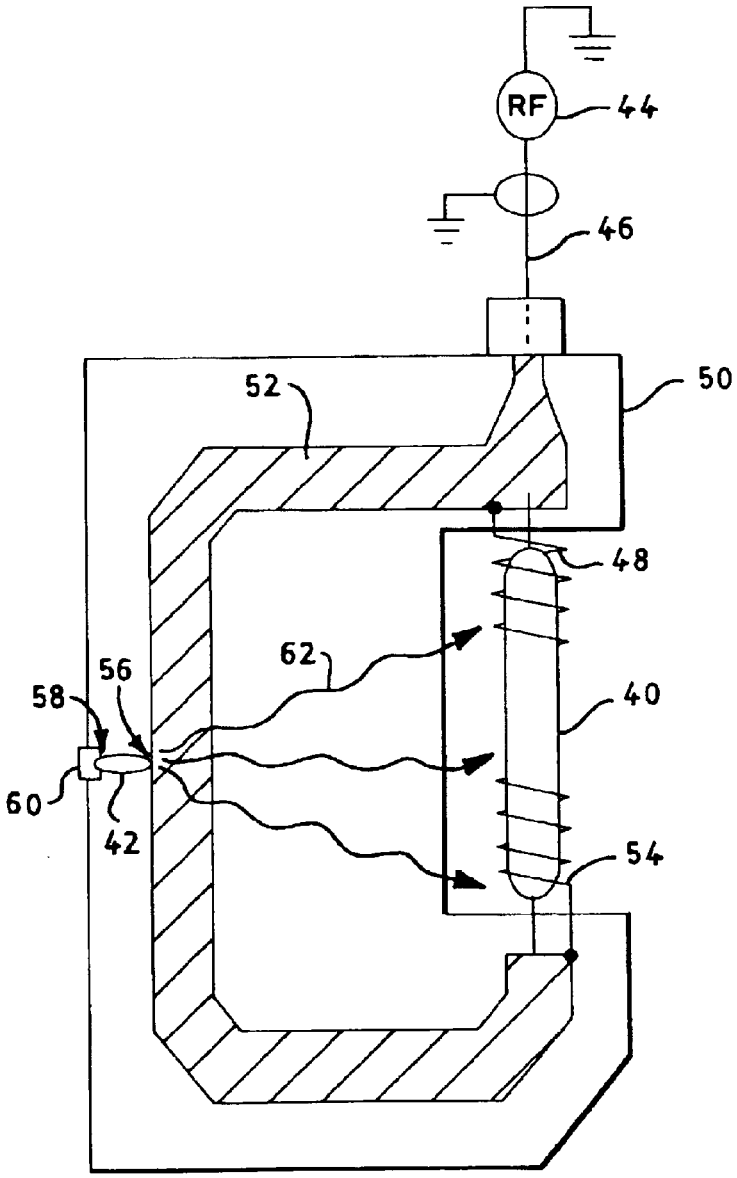
FIG. 4 is a pictorial representation of yet a further embodiment of a UV enhancer of the present invention with an electrodeless starting capsule.

In a yet further embodiment illustrated in FIG. 4, the metal halide lamp 40 may be electrodeless and may include an electrodeless mercury-free UV enhancer 42 for a starter capsule. In this embodiment, the high frequency needed to excite UV enhancer 42 is provided by the radio frequency (RF) powering lamp 40.

The electrodeless lamp is discussed in the above-mentioned U.S. Pat. No. 5,070,277 and the details are omitted here. Generally, a radio frequency source 44 produces a radio frequency power capable of inducing breakdown of the fill in lamp 40. Radio frequency power is fed through transmission line 46 and coupler 48 into lamp 40. A first side of dielectric support 50 includes a conductive strip 52 (e.g., a microstripline) that feeds power from transmission line 46 to coupler 54.

UV enhancer 42 has one end 56 in close proximity to conductive strip 52 and its other end 58 connected to a ground plane (not shown) on the opposite surface of support 50, such as with a metal foil connector 60. UV enhancer 42 may be attached to support 50 and/or conductive strip 52 with an adhesive. Capacitive coupling between the two ends of UV enhancer 42 causes it to emit UV radiation 62 to reduce the voltage needed to start lamp 40. UV enhancer 42 has no internal electrodes.

Figure 5:
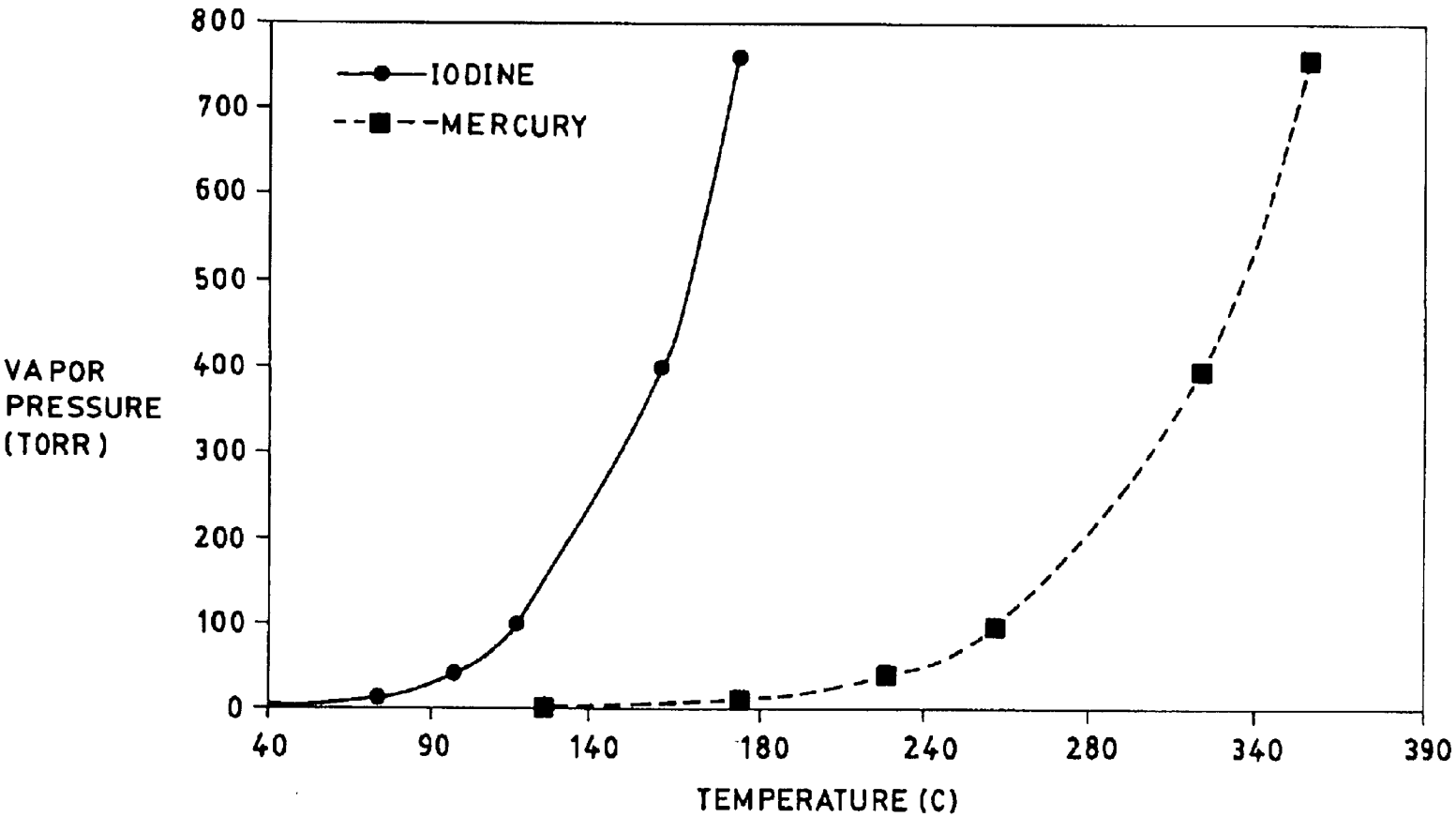
FIG. 5 is a chart comparing iodine and mercury vapor pressure as a function of temperature.

FIG. 5 is chart comparing iodine vapor pressure to mercury vapor pressure. At low temperatures, the iodine vapor pressure may be only fractions of a torr. However, this is sufficient to generate the UV radiation necessary to start the lamp. Note that the UV enhancer of the present invention has a much higher vapor pressure at low temperatures and thus is probably more efficient than a mercury starter at low temperature.

While embodiments of the present invention have been described in the foregoing and in the drawings, it is to be understood that the present invention is defined solely by the following claims when read in light of the specification and drawings.

We claim:

1. An ultraviolet (UV) enhancer for a metal halide lamp, said UV enhancer comprising a UV-transmissive capsule with a cavity in which iodine and an inert gas are sealed and that emits UV radiation when the iodine is excited to reduce a starting voltage of the metal halide lamp.

2. The UV enhancer of claim 1, further comprising an electrode inlead with one end in said cavity and another end outside said capsule.

3. The UV enhancer of claim 1, wherein the UV enhancer is free of mercury.

4. The UV enhancer of claim 1, wherein the iodine is in the form of at least one of $CH_3I$, HI, and $SiI_4$.

5. The UV enhancer of claim 1, wherein the iodine comprises iodine crystals.

6. The UV enhancer of claim 5 further comprising an inner tube that contains said iodine crystals, said inner tube being inside said cavity, said inert gas being outside said inner tube.

7. The UV enhancer of claim 6, further comprising an electrode inlead with one end attached to an end of said inner tube and another end outside said capsule.

8. The UV enhancer of claim 1, wherein the iodine comprises iodine vapor that is mixed with said inert gas.

9. The UV enhancer of claim 8, further comprising an electrode inlead with one end in said cavity and another end outside said capsule, and an electrode rod attached to said one end of said electrode inlead.

10. The UV enhancer of claim 1, wherein the inert gas comprises argon.

11. The UV enhancer of claim 1, wherein the inert gas comprises xenon.

12. The UV enhancer of claim 1, wherein the inert gas comprises krypton.

13. The UV enhancer of claim 1, wherein said capsule comprises a material selected from the group of UV transmissive materials consisting of vitreous silica (quartz), Suprasil, ceramic, and hard glass.

14. A metal halide lamp comprising:

an outer tube;

a discharge vessel inside said outer tube, said discharge vessel having two discharge electrodes that extend from outside said vessel to a discharge space within said vessel; and an ultraviolet (UV) transmitting starting aid in said outer tube and comprising a capsule with a cavity that has iodine and an inert gas sealed therein.

15. The lamp of claim 14, wherein the iodine comprises one of iodine crystals and iodine vapor.

16. The lamp of claim 14, wherein the iodine is in the form of at least one of $CH_3I$, HI, and $SiI_4$.

17. The lamp of claim 14, wherein the inert gas comprises is one of argon, xenon, and krypton.

18. The lamp of claim 14, wherein said starting aid further comprises an electrode inlead with one end in said cavity and another end connected to a first of said two discharge electrodes.

19. The lamp of claim 18, wherein said starting aid is adjacent to a second of said two discharge electrodes.

20. A method of starting a metal halide lamp, comprising the steps of reducing a starting voltage of the lamp by exciting iodine that is sealed with an inert gas in a UV enhancer in the lamp to cause emission of UV radiation, and starting the lamp with the reduced starting voltage.

21. The method of claim 20, wherein the inert gas is xenon, and further comprising the step of forming excimer molecules during start of the lamp as a result of interaction of the xenon and the iodine.

* * * * *